US006025784A

United States Patent [19]

Mish

[11] Patent Number: 6,025,784

[45] Date of Patent: Feb. 15, 2000

[54] VEHICLES, LICENSE PLATE FRAME ASSEMBLIES, METHODS OF FORMING LICENSE PLATE FRAMES, AND METHODS OF ATTACHING RFIDS, TRANSPONDERS AND MODULATORS TO VEHICLES

[75] Inventor: William Mish, Boise, Id.

[73] Assignee: Micron Technology, Inc., Boise, Id.

[21] Appl. No.: 09/022,963

[22] Filed: Feb. 12, 1998

[51] Int. Cl.[7] ..... G08B 23/00

[52] U.S. Cl. ..... 340/693.5; 340/933; 343/713; 343/741; 343/866

[58] Field of Search ..... 340/693.5, 825.34, 340/825.33, 825.31, 937, 933; 343/713, 711, 741, 866, 892; 705/1, 13; 235/384; 342/42, 44, 51

[56] References Cited

U.S. PATENT DOCUMENTS

| | | | |
|---|---|---|---|
| 4,001,822 | 1/1977 | Sterzer | 342/44 |
| 4,075,632 | 2/1978 | Baldwin et al. | 343/6.8 |
| 4,418,411 | 11/1983 | Strietzel | 340/825.34 X |
| 4,926,182 | 5/1990 | Ohta et al. | 342/44 |
| 5,111,207 | 5/1992 | Allen | 342/20 |
| 5,177,494 | 1/1993 | Dorrie et al. | 343/711 |
| 5,196,846 | 3/1993 | Brockelsby et al. | 340/933 |
| 5,621,412 | 4/1997 | Sharpe et al. | 342/51 |
| 5,649,296 | 7/1997 | MacLellan et al. | 455/38.2 |
| 5,657,008 | 8/1997 | Bantli | 340/933 |

*Primary Examiner*—Thomas J. Mullen, Jr.
*Attorney, Agent, or Firm*—Wells, St. John, Roberts, Gregory & Matkin, P.S.

[57] ABSTRACT

The invention encompasses license plate frame assemblies having modulators, transponders or radio frequency identification devices (RFIDs) incorporated therein. Further, the invention encompasses methods of attaching transponders, modulators, and RFIDs to vehicles. In one aspect, the invention includes a method of forming a license plate frame comprising: providing a license plate frame substrate, the license plate frame substrate being configured to mount to a vehicle and being configured to receive and retain a license plate; and mounting a transponder to the license plate frame substrate. In another aspect, the invention includes a method of attaching an RFID to a vehicle comprising: providing a license plate frame, the license plate frame being configured to mount to a vehicle and being configured to receive and retain a license plate in a configuration wherein characters on the license plate are viewable to persons proximate the vehicle when the license plate frame with a license plate retained therein is mounted to the vehicle; mounting an RFID to the license plate frame; and retaining the license plate on the vehicle with the license plate frame. In yet another aspect, the invention includes a license plate frame assembly comprising: a license plate frame; and an antenna joined to the license plate frame.

39 Claims, 6 Drawing Sheets

VEHICLES, LICENSE PLATE FRAME ASSEMBLIES, METHODS OF FORMING LICENSE PLATE FRAMES, AND METHODS OF ATTACHING RFIDS, TRANSPONDERS AND MODULATORS TO VEHICLES

TECHNICAL FIELD

The invention pertains to license plate frame assemblies having modulators, transponders or radio frequency identification devices (RFIDs) incorporated therein. Further, the invention pertains to methods of attaching transponders, modulators, and RFIDs to vehicles.

BACKGROUND OF THE INVENTION

Remote identification of a vehicle is a process whereby a vehicle is identified by a machine external to the vehicle. Many applications exist for remote vehicle identification. Such applications include, for example, toll collection booths and fuel stations. Toll booths capable of remotely identifying vehicles could automatically assess charges against the owners of passing vehicles, and then bill the owners digitally. This would enable persons to pay tolls without having to slow down at the toll booths to deposit currency. As cars would not have to slow at the toll booths, traffic through the toll booths would be substantially unimpeded by the presence of the toll booths; saving time for persons travelling the tolled roads.

Remote identification of vehicles by fuel stations would enable the stations to automatically reset a fuel pump and begin charging a vehicle's owner for fuel dispensed to a vehicle. This would save time at gas stations that is otherwise utilized for persons to pay their fuel filling bill. Also, it could reduce personnel required at gas stations, as many of the functions of such personnel would become automatic. Also, as vehicles would be remotely identified before they were filled with gas, there would be little opportunity for would be thieves to fill their tanks and leave without paying.

For the above-discussed reasons, it is desirable to develop methods and apparatuses for remotely identifying vehicles.

SUMMARY OF THE INVENTION

In one aspect, the invention encompasses a method of forming a license plate frame. A license plate frame substrate is provided. The license plate frame substrate is configured to mount to a vehicle. The license plate frame substrate is further configured to receive and retain a license plate. A transponder is mounted to the license plate frame substrate.

In another aspect, the invention encompasses a method of attaching an RFID to a vehicle. A license plate frame is provided. The license plate frame is configured to mount to a vehicle. The license plate frame is further configured to receive and retain a license plate in a configuration wherein characters on the license plate are viewable to persons proximate the vehicle when the license plate frame with a license plate retained therein is mounted to the vehicle. An RFID is mounted to the license plate frame. The license plate frame is utilized to mount a license plate to the vehicle.

In another aspect, the invention encompasses a vehicle. The vehicle has an interior compartment and a body surrounding the interior compartment. The body has an exterior surface. The vehicle also has an RFID mounted to the exterior surface of the body. The RFID includes an integrated circuit.

BRIEF DESCRIPTION OF THE DRAWINGS

Preferred embodiments of the invention are described below with reference to the following accompanying drawings.

FIG. 5 is an exploded side view of the FIG. 1 license plate holder being mounted onto a vehicle.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

In one aspect, the invention encompasses a method for remote identification of a vehicle wherein a modulating device is attached to an exterior of the vehicle. The modulating device can define a transponder. In a preferred aspect of the invention, the transponder is comprised by an RFID. Example RFID circuitry is disclosed in the commonly assigned U.S. patent application Ser. No. 08/705,043, filed Aug. 29, 1996, which is hereby incorporated by reference. RFID circuitry associated with vehicles is disclosed in commonly assigned U.S. patent application Ser. No. 08/759,737, filed Dec. 6, 1996, which is hereby incorporated by reference. In applications of the invention in which a modulator is incorporated in an RFID, the modulator is preferably a backscatter modulator. Backscatter modulators are preferred for RFIDs for economy of power.

A preferred method for mounting a modulator to an exterior of a vehicle is to incorporate the modulator into a license plate frame. A first embodiment license plate frame 10 of the present invention is described with reference to FIGS. 1–3. License plate frame 10 comprises a license plate frame substrate 12 configured to mount to a vehicle and configured to receive and retain a license plate. License plate frame substrate 12 comprises a plurality of holes 14 configured for receiving screws (shown in FIG. 6 as 68). Such screws can be inserted through a license plate (shown in FIG. 6 as 66) and into receptacles on a vehicle (not shown) to secure the license plate to the vehicle.

Figure 1:
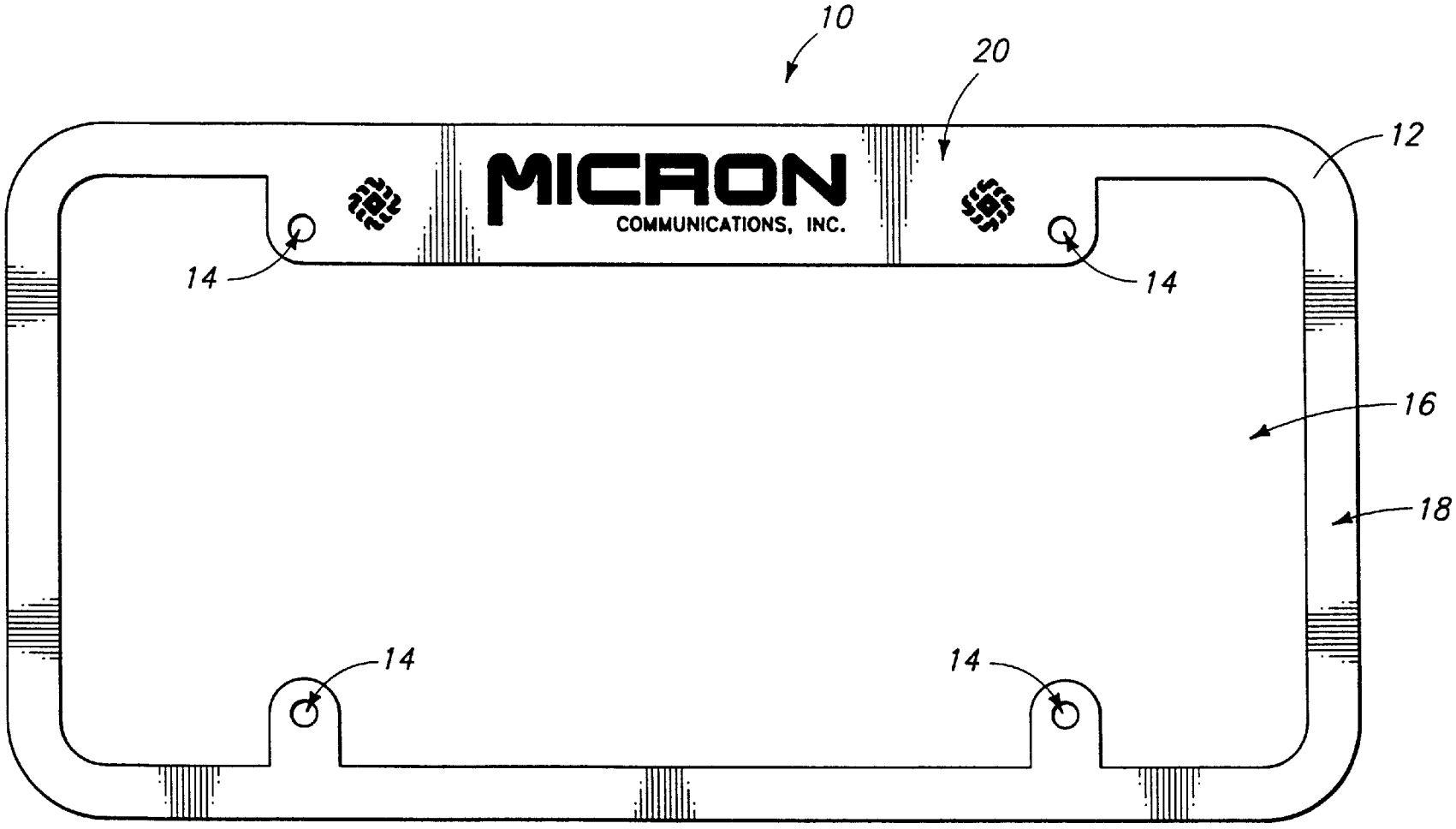
FIG. 1 is a front view of a license plate holder in accordance with the present invention.

License plates typically have a surface comprising a series of alpha-numeric characters unique to the license plate and utilized for identifying an owner of the license plate. License plate frame substrate 12 comprises a perimeter 18 around an orifice 16. The perimeter is configured to retain a license plate and overlay the surface of the license plate comprising the alpha-numeric characters. The alphanumeric characters are viewable through orifice 16 to persons proximate the license plate when the perimeter is overlaid on the license plate. In the front view of FIG. 1, license plate frame 10 resembles a conventional license plate frame. License plate frame 10 comprises a widened, or downwardly deepened, portion 20 of the perimeter 18. A front surface of widened portion 20 can be provided with symbols and logos for, for example, advertising purposes. Exemplary symbols and logos are shown in FIG. 1.

License plate frame 10 will preferably be from about ⅛ inch thick to about 1 inch thick, and will most preferably be about ¼ inch thick.

Figure 2:
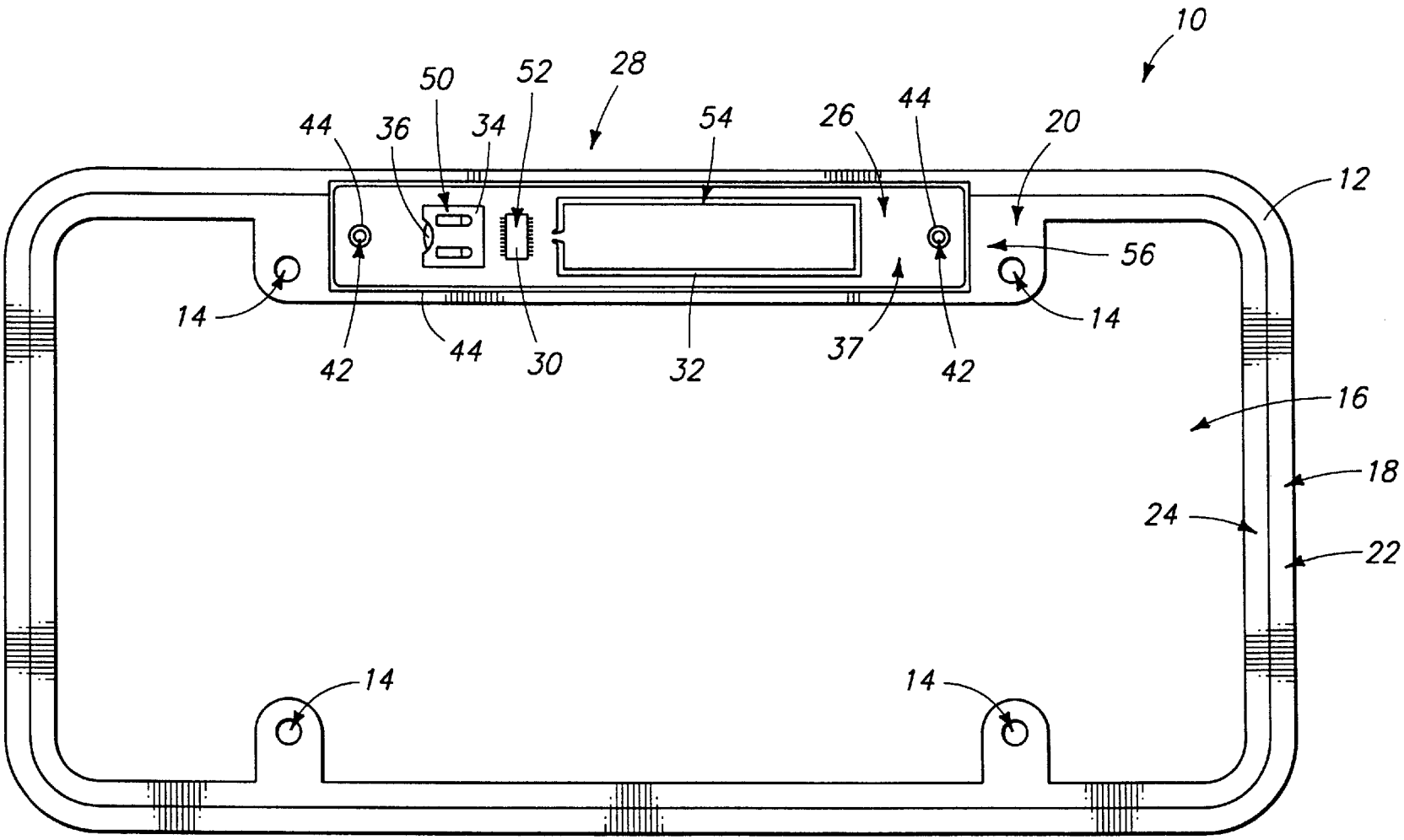
FIG. 2 is a back view of the license plate holder of FIG. 1.

In the back view of FIG. 2, it is shown that perimeter 18 can comprise a pair of different elevation surfaces 22 and 24, with surface 24 being recessed relative to surface 22. Perimeter 18 is preferably configured such that a license plate will fit snugly within recessed portion 24. License plate frame 10 can be dimensioned, for example, for retaining European-style license plates or U.S.-style license plates.

The back surface of widened portion 20 has an opening, or recess, 26 provided therein. Substrate 12 comprises a substantially planar outermost surface 56 proximate opening 26. An RFID 28 is mounted within opening 26. RFID 28 comprises an integrated circuit 30 and a loop antenna 32. Integrated circuit 30 and antenna 32 are bonded to a circuit card assembly 37, and comprise outermost surfaces 52 and 54, respectively. Integrated circuit 30 and antenna 32 are electrically connected by interconnects which, in the shown preferred embodiment, are beneath circuit card 37 and not viewable in the orientation of FIG. 2. Loop antenna 32 can be formed, for example, by printing a conductive material onto circuit card 37. Alternatively, loop antenna 32 can be formed by placing a conductive strip within opening 26. Antenna 32 is preferably configured (e.g. sized) to operate at microwave frequencies. If transmission using backscatter modulation is desired a dipole antenna is provided on circuit card assembly 37 in addition to loop antenna 32. The dipole antenna is used for backscatter modulation, and loop antenna 32 is used for reception.

A battery holder 34 is also provided within opening 26 and mounted to circuit card 37. Battery holder 34 comprises an outermost surface 50. A battery 36 is provided within battery holder 34 and in electrical connection with integrated circuit 30 through electrical interconnects. In the shown embodiment, the interconnects are beneath circuit card 37 and not visible in the FIG. 2 view. Battery 36 is preferably removably retained within holder 34 such that battery 36 can be easily replaced when it drains. Alternative methods for mounting battery 36 in electrical connection with integrated circuit 30 are, for example, soldering and gluing. In still other alternative embodiments, battery 36 can be provided as a component part of integrated circuit 30.

A cover 38 (shown in FIG. 3, but not shown in FIG. 2 for clarity) is provided over opening 26 to protect RFID 28 and battery 36. Cover 38 preferably overlays an entirety of opening 26 to protect the electronic components within opening 26 from dust and moisture. Openings 42 are provided within substrate 12 and configured for receiving screws 40 which secure cover 38 to substrate 12. Screws 40 preferably comprise flat heads to minimize damage that screws 40 can otherwise cause to a vehicle to which frame 10 is attached. Also, screws 40 can comprise heads configured to make the screws more difficult to remove than to insert. Such heads, which may be referred to as anti-theft heads, can impede persons from swapping RFID devices from one license plate frame with another.

A sealant layer 44 is preferably provided around a periphery of opening 26, as well as around peripheries of openings 42. Sealant layer 44 can comprise, for example, flexible rubber material. Cover 38 preferably sealingly engages sealant layer 44 to prevent moisture from entering opening 26 after cover 38 is in place. In the shown embodiment, cover 38 is removably mounted to license plate frame substrate 12. In other embodiments of the invention, cover 38 can be relatively permanently mounted to substrate 12 by, for example, soldering, welding or gluing.

In the shown embodiment, opening 26 extends only partially into substrate 12. In alternate embodiments, opening 26 can be configured to extend entirely through substrate 12. However, most preferred is that opening 26 extend only partially into substrate 12, and be deep enough such that outermost surfaces 50, 52 and 54 of battery housing 34, integrated circuit 30 and antenna 32, respectively, do not extend outwardly beyond outermost surface 56 of substrate 12 proximate opening 26. Such relative configuration of outermost surfaces 50, 52 and 54 relative to outermost surface 56 ensures that cover 38 can fit tightly over opening 26.

Figure 3:
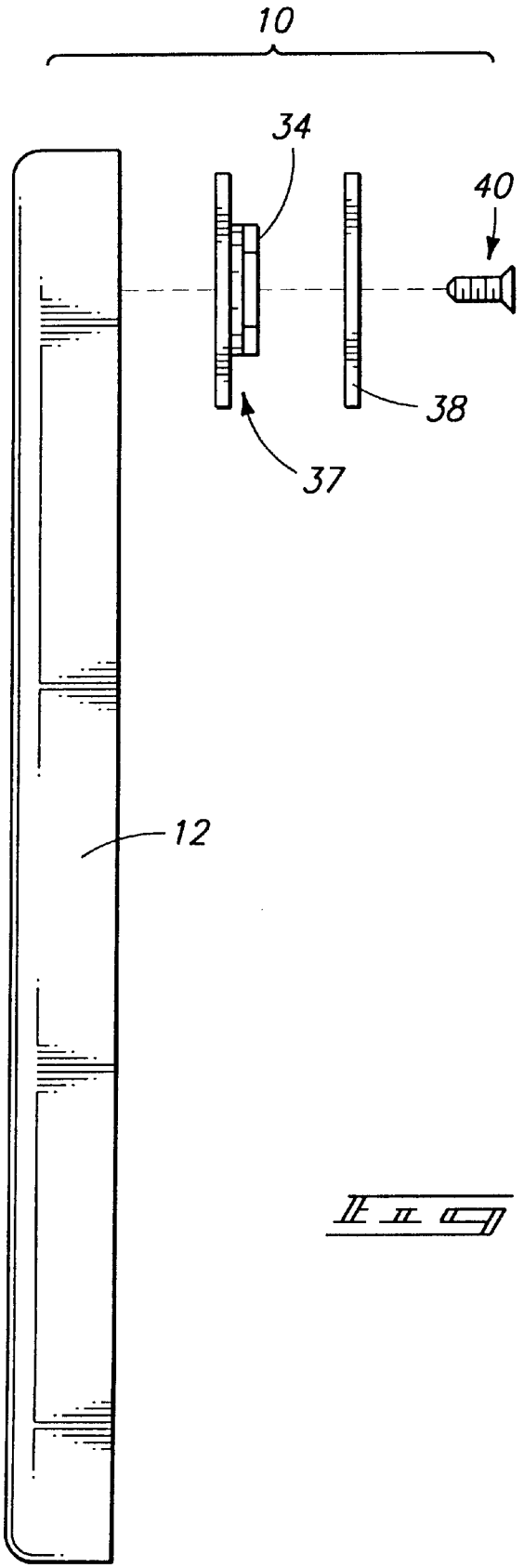
FIG. 3 is an exploded side view of the license plate holder of FIG. 1.

License plate frame substrate 12 can consist essentially of an insulative material, such as high impact plastic, or polyvinyl chloride (PVC), and can be formed by injection molding the material into the configuration shown in FIGS. 1–3. Such materials will not interfere with radio frequency communications. Opening 26 can be formed during the injection molding process. Alternatively, opening 26 can be formed after the injection molding process by, for example, cutting opening 26 into license plate frame substrate 12.

Figure 4:
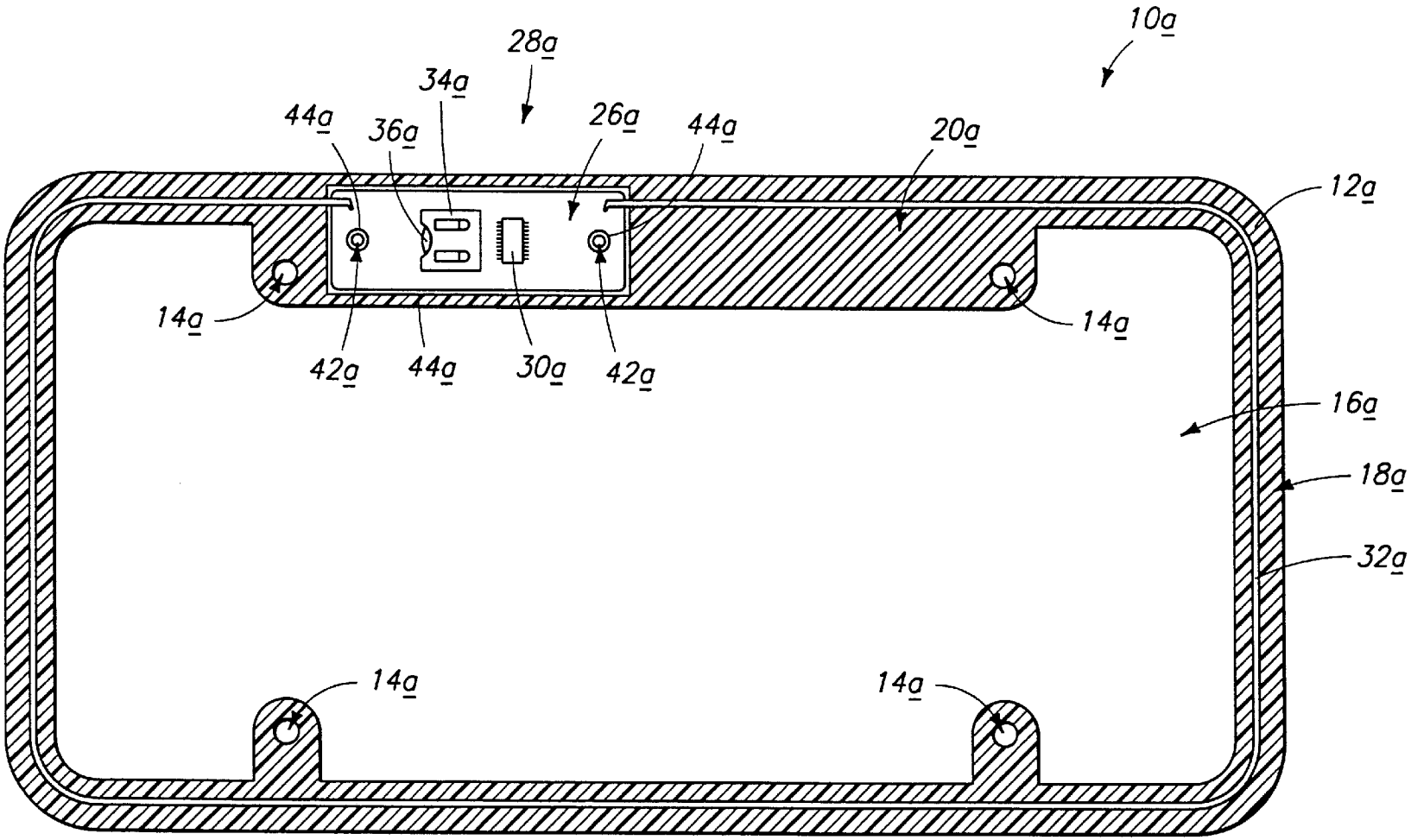
FIG. 4 is a back cross-sectional view of an alternate embodiment of a license plate frame of the present invention.
Figure 11:
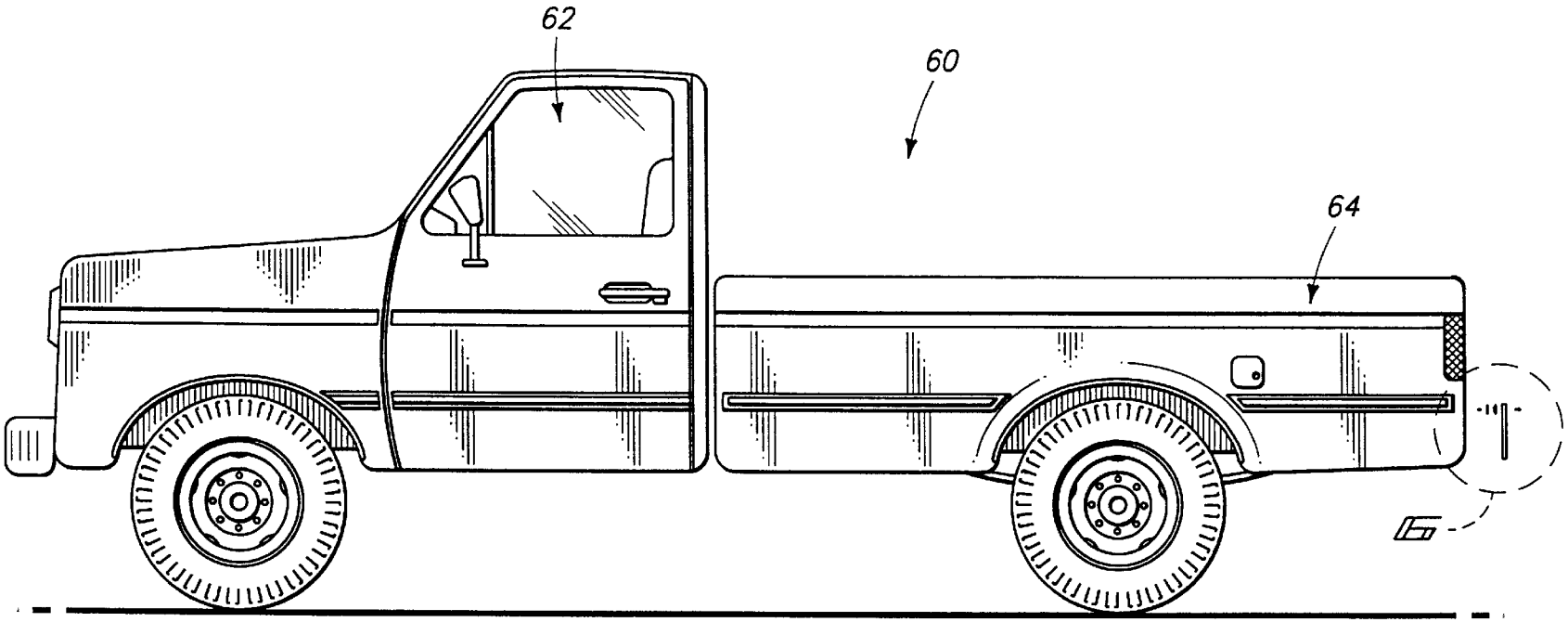

FIG. 4 shows an alternative embodiment of a license plate frame of the present invention. In referring to FIG. 4, similar numbering to that used above in describing FIGS. 1–3 will be utilized, with differences indicated by the suffix "a" or by different numerals. License plate frame 10*a* comprises a substrate 12*a* which preferably comprises an insulative material, such as PVC or plastic. Substrate 12*a* comprises a perimeter 18*a* surrounding an orifice 16*a*. Perimeter 18*a* is configured to extend around an outer surface of a license plate (not shown). Antenna 32*a* is a loop antenna configured to extend entirely around perimeter 18*a* and surround orifice 16*a*. Loop antenna 32*a* is electrically connected to integrated circuit 30*a* through interconnects which are not shown. Only a portion of antenna 32*a* is within opening 26*a*. Antenna 32*a* can be formed, for example, by providing a conductive strip within substrate 12*a* as the substrate is injection molded from a plastic material. The larger loop antenna 32*a* can provide increased range and performance relative to the smaller loop antenna 32 (shown in FIG. 2).

Opening 26*a* is shown smaller than opening 26 (shown in FIG. 2) because opening 26*a* does not encompass an entirety of an antenna as does opening 26. Opening 26*a* can also be the same size as opening 26, or larger than opening 26, in alternative embodiments of the invention.

Figure 6:
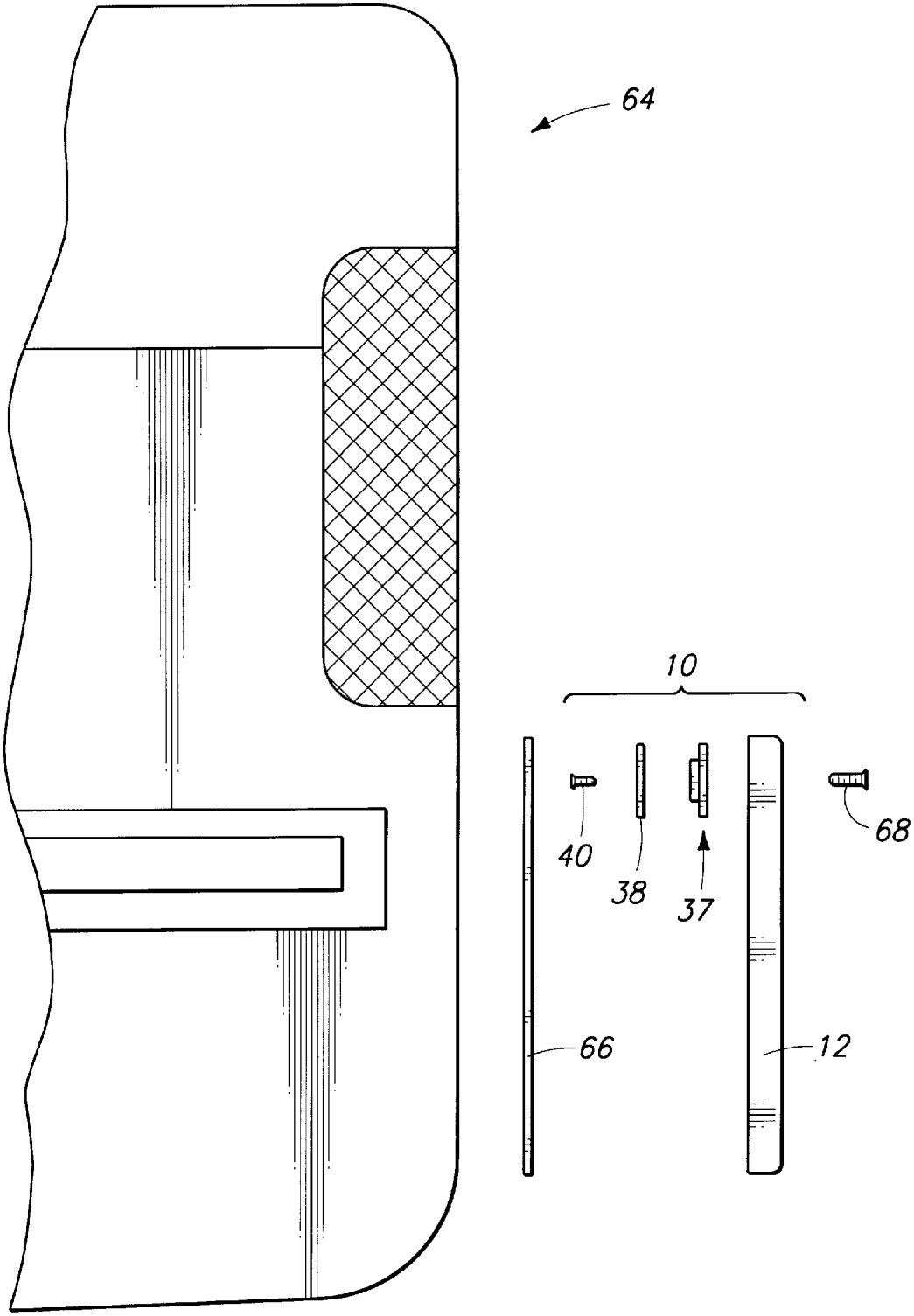
FIG. 6 is a zoom view of the region labelled "6" in FIG. 5.

Referring to FIGS. 5 and 6, license plate frame 10 of FIGS. 1–3 is shown in an exploded view being mounted to a vehicle 60. Vehicle 60 comprises an interior compartment 62 configured for retaining passengers and an exterior surface 64 surrounding interior compartment 62. Circuit card assembly 37 is mounted to license plate frame substrate 12 as described above in describing FIGS. 1–3. Also, cover 38 is adhered over circuit card assembly 37 with a screw 40 as described above. After cover 38 is adhered over circuit card assembly 37, license plate frame 10 is provided over a license plate 66 and utilized to secure license plate 66 onto exterior surface 64 of vehicle 50. Specifically, one or more screws 68 are provided through openings 14 (shown in FIGS. 1–3) and threadedly engaged with vehicle 60 to retain license plate frame 10 and license plate 66 to vehicle 60.

In the shown preferred embodiment, screws 40 are positioned between license plate frame 10 and vehicle exterior 64. Such positioning of screws 40 renders it is more difficult for would be thieves to steal RFID circuitry 28 from license plate frame 10. To further impede stealing of RFID circuitry 28, screws 68 can be configured to be more difficult to remove than to insert, or to be removable only with specialized tools. It is noted that theft of license-plateframemounted RFID devices of the present invention can be further diminished by taking pictures of remotely identified cars. For instance, toll booths are typically equipped with cameras that read license plates of cars passing by to identify vehicles that pass through without paying. Toll booths equipped to remotely identify cars can utilize digital processing equipment associated with the toll booths, or a human operator, to rapidly associate a license plate number with an improper RFID signal (e.g. for an RFID device reported as being stolen) so that a thief of the RFID can be identified and apprehended.

Although the shown embodiment is described as having RFID 28 powered by a battery 36, alternative embodiments can be constructed wherein RFID 28 is powered by an electrical system of vehicle 60. In such alternative embodiments, power from the vehicle can be stepped down from 12 volts to a voltage more reasonable for driving RFID 28, such as about 3 volts.

The present system for mounting an RFID to an exterior of a vehicle has advantages over systems in which an RFID is merely retained within a passenger compartment of a vehicle. For instance, RFIDs sometimes will not work through the window heaters frequently found associated with vehicle windows. The present invention places the RFID externally of any vehicle windows, and thus avoids the problem of transmitting through a window heater. Also, by having a RFID device relatively permanently adhered to the vehicle in the form of a license plate frame, it is less likely that a person driving the vehicle will forget the RFID device before traveling in the vehicle, lose the RFID device, or confuse multiple RFID devices in multi-vehicle households.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A method of forming a license plate frame comprising:

providing a license plate frame substrate, the license plate frame substrate being configured to mount to a vehicle and being configured to receive and retain a license plate;

mounting a transponder to the license plate frame substrate, the transponder being comprised by an RFID; and wherein the license plate frame substrate comprises a perimeter around an orifice, the perimeter being configured to retain the license plate and to overlay a surface of the license plate, the orifice being configured to permit characters on the license plate surface to be viewable to persons proximate the license plate surface when the perimeter is overlaid on the license plate surface, the method further comprising providing a loop antenna proximate the license plate frame substrate, the loop antenna extending entirely around the perimeter and surrounding the orifice, the loop antenna being in electrical communication with the RFID.

2. A method of forming a license plate frame comprising:

providing a license plate frame substrate, the license plate frame substrate being configured to mount to a vehicle and being configured to receive and retain a license plate; wherein the license plate frame substrate comprises a perimeter around an orifice, the perimeter being configured to retain the license plate and to overlay a surface of the license plate, the orifice being configured to permit characters on the license plate surface to be viewable to persons proximate the license plate surface when the perimeter is overlaid on the license plate surface;

mounting a transponder to the license plate frame substrate, the transponder being comprised by an RFID;

providing a loop antenna which extends entirely around the perimeter and surrounds the orifice, the antenna being in electrical communication with the RFID; and mounting a battery to the license plate frame substrate, the battery being in electrical communication with the RFID.

3. A method of forming a license plate frame comprising:

providing a license plate frame substrate, the license plate frame substrate being configured to mount to a vehicle and being configured to receive and retain a license plate;

mounting a transponder to the license plate frame substrate, the transponder being comprised by an RFID; and wherein the mounting the RFID to the license plate frame substrate comprises:

providing an opening in the license plate frame substrate; and mounting the RFID within the opening.

4. The method of claim 3 wherein the license plate frame substrate comprises a substantially planar surface proximate the opening and wherein the RFID comprises an outermost surface after the RFID is mounted within the opening, the RFID outermost surface not extending outwardly beyond the license plate frame substrate surface proximate the opening.

5. The method of claim 3 wherein the license plate frame substrate is formed by molding a material into a license plate frame shape and wherein the opening is formed during the molding.

6. The method of claim 3 wherein the opening in the license plate frame substrate is formed by cutting the opening into the license plate frame substrate.

7. The method of claim 3 wherein the opening in the license plate frame substrate extends only partially into the license plate frame substrate.

8. The method of claim 3 wherein the opening in the license plate frame substrate extends only partially into the license plate frame substrate and further comprising providing a cover over the RFID after mounting the RFID within the opening.

9. The method of claim 3 wherein the opening in the license plate frame substrate extends only partially into the license plate frame substrate and further comprising:

providing a sealant material around a periphery of the opening; and providing a cover over the RFID after mounting the RFID within the opening, the cover sealingly engaging the sealant material.

10. The method of claim 9 wherein the cover is removably mounted to the license plate frame substrate.

11. The method of claim 9 wherein the cover is removably mounted to the license plate frame substrate and further comprising providing a battery within the opening and in electrical connection with the RFID, the battery being removably attached within the opening.

12. The method of claim 3 further comprising providing an antenna proximate the license plate frame substrate, an entirety of the antenna being within the opening, the antenna being in electrical communication with the RFID.

13. The method of claim 3 wherein the license plate frame substrate comprises a perimeter around an orifice, the perimeter being configured to retain the license plate and to overlay a surface of the license plate, the orifice being configured to permit characters on the license plate surface to be viewable to persons proximate the license plate surface when the perimeter is overlaid on the license plate surface, the method further comprising providing a loop antenna proximate the license plate frame substrate, the loop antenna extending entirely around the perimeter and surrounding the orifice, the loop antenna being in electrical communication with the RFID.

14. The method of claim 3 wherein the license plate frame substrate comprises a perimeter around an orifice, the perimeter being configured to retain the license plate and to overlay a surface of the license plate, the orifice being configured to permit characters on the license plate surface to be viewable to persons proximate the license plate surface when the perimeter is overlaid on the license plate surface, the method further comprising:

providing a loop antenna which extends entirely around the perimeter and surrounds the orifice, the antenna being in electrical communication with the RFID; and mounting a battery within the opening in the license plate frame substrate, the battery being in electrical communication with the RFID.

15. The method of claim 3 wherein the license plate frame substrate comprises a perimeter around an orifice, the perimeter being configured to retain the license plate and to overlay a surface of the license plate, the orifice being configured to permit characters on the license plate surface to be viewable to persons proximate the license plate surface when the perimeter is overlaid on the license plate surface, the method further comprising:

providing a loop antenna which extends entirely around the perimeter and surrounds the orifice, the antenna being in electrical communication with the RFID;

providing a battery within the opening in the license plate frame substrate, the battery being in electrical communication with the RFID; and after providing the RFID and the battery within the opening, providing a cover over the opening, the cover being over the battery and the RFID.

16. A method of attaching an RFID to a vehicle comprising:

providing a license plate frame, the license plate frame being configured to mount to a vehicle and being configured to receive and retain a license plate in a configuration wherein characters on the license plate are viewable to persons proximate the vehicle when the license plate frame with a license plate retained therein is mounted to the vehicle;

mounting an RFID to the license plate frame;

retaining the license plate on the vehicle with the license plate frame; and wherein the license plate frame comprises an opening and the RFID is mounted within the opening.

17. A method of attaching an RFID to a vehicle comprising:

providing a license plate frame, the license plate frame being configured to mount to a vehicle and being configured to receive and retain a license plate in a configuration wherein characters on the license plate are viewable to persons proximate the vehicle when the license plate frame with a license plate retained therein is mounted to the vehicle;

mounting an RFID to the license plate frame;

retaining the license plate on the vehicle with the license plate frame; and wherein the license plate frame comprises a surface configured to face the vehicle, and an opening extending through the surface, and wherein the RFID is mounted within the opening.

18. A method of attaching an RFID to a vehicle comprising:

providing a license plate frame, the license plate frame being configured to mount to a vehicle and being configured to receive and retain a license plate in a configuration wherein characters on the license plate are viewable to persons proximate the vehicle when the license plate frame with a license plate retained therein is mounted to the vehicle;

mounting an RFID to the license plate frame;

retaining the license plate on the vehicle with the license plate frame; and wherein the license plate frame comprises a surface configured to face the vehicle, and an opening extending through the surface, and wherein the RFID is mounted within the opening and covered before retaining the license plate with the license plate frame.

19. A method of attaching an RFID to a vehicle comprising:

providing a license plate frame, the license plate frame being configured to mount to a vehicle and being configured to receive and retain a license plate in a configuration wherein characters on the license plate are viewable to persons proximate the vehicle when the license plate frame with a license plate retained therein is mounted to the vehicle;

mounting an RFID to the license plate frame;

retaining the license plate on the vehicle with the license plate frame;

wherein the license plate frame comprises:

a perimeter around an orifice, the perimeter being configured to retain the license plate, the perimeter having a surface configured to face the vehicle;

a loop antenna which extends entirely around the perimeter and surrounds the orifice, the loop antenna being configured to be in electrical communication with the RFID after the RFID is mounted; and an opening extending through the surface of the perimeter;

and wherein the RFID is mounted within the opening before retaining the license plate with the license plate frame.

20. The method of claim 19 further comprising:

providing a protective cover over the RFID before retaining the license plate with the license plate frame.

21. The method of claim 19 further comprising:

providing a protective cover over the RFID before retaining the license plate with the license plate frame; and wherein the retaining comprises mounting the license plate between the license plate frame and the vehicle.

22. A method of attaching a modulator to a vehicle comprising the following steps in the following sequence:

mounting the modulator to a license plate frame; and mounting the license plate frame to the vehicle.

23. The method of claim 22 wherein the modulator is a backscatter modulator.

24. A method of attaching a transponder to a vehicle comprising the following steps in the following sequence:

mounting the transponder to a license plate frame; and mounting the license plate frame to the vehicle.

25. The method of claim 24 wherein the license plate frame has a front and a back, the transponder being mounted proximate the back of the license plate frame, and wherein the license plate frame is mounted to the vehicle with the back of the license plate frame facing the vehicle.

26. The method of claim 24 wherein the mounting includes mounting the transponder to render the transponder inaccessible for removal while the license plate is attached to the vehicle.

27. The method of claim 24 wherein the transponder is comprised by an RFID.

28. A license plate frame assembly comprising:

a license plate frame; and an antenna joined to the license plate frame; and wherein the license plate frame consists essentially of an insulative material.

29. A license plate frame assembly comprising:

a license plate frame; and an antenna joined to the license plate frame; and wherein the antenna is a loop antenna.

30. A license plate frame assembly comprising:

a license plate frame; and an antenna joined to the license plate frame, wherein the license plate frame has a surface and an opening extending partially into the surface, and wherein the antenna is within the opening; and wherein only a portion of the antenna is within the opening.

31. A license plate frame assembly comprising:

a license plate frame; and an antenna joined to the license plate frame, wherein the license plate frame has a surface and an opening extending partially into the surface, and wherein the antenna is within the opening;

an RFID within the opening and electrically connected to the antenna; and a battery within the opening and electrically connected to the RFID.

32. The license plate frame assembly of claim 31 further comprising:

a cover over the battery and over the RFID.

33. A license plate frame assembly comprising:

a license plate frame; and an antenna joined to the license plate frame; and wherein the license plate frame comprises a perimeter around an orifice, the perimeter being configured to retain a license plate, the orifice being configured to permit characters on a surface of the license plate to be viewable to persons when the perimeter is overlaid on the surface of the license plate, and wherein the antenna is a loop antenna which extends entirely around the perimeter and surrounds the orifice.

34. The license plate frame assembly of claim 33 further comprising:

an RFID electrically connected to the antenna.

35. The license plate frame assembly of claim 33 further comprising:

an RFID electrically connected to the loop antenna; and a battery electrically connected to the RFID.

36. A vehicle comprising:

an interior compartment and a body surrounding the interior compartment, the body having an exterior surface;

an RFID mounted to the exterior surface of the body, the RFID comprising an integrated circuit; and a license plate frame assembly mounted to the exterior surface of the body, the license plate frame assembly comprising:

a license plate frame; and a loop antenna joined to the license plate frame, the loop antenna being in electrical connection with the RFID.

37. A vehicle comprising:

an interior compartment and a body surrounding the interior compartment, the body having an exterior surface;

an RFID mounted to the exterior surface of the body the RFID comprising an integrated circuit; and a license plate frame assembly mounted to the exterior surface of the body, the license plate frame assembly comprising:

a license plate frame having a surface;

an opening extending through the surface, the opening extending only partially into the license plate frame; and a loop antenna within the opening, the loop antenna being in electrical connection with the RFID.

38. The vehicle of claim 37 wherein the license plate frame assembly further comprises a battery within the opening, the battery being in electrical connection with the RFID.

39. A vehicle comprising:

an interior compartment and a body surrounding the interior compartment, the body having an exterior surface;

an RFID mounted to the exterior surface of the body, the RFID comprising an integrated circuit; and a license plate frame assembly mounted to the exterior surface of the body, the license plate frame assembly comprising:

a license plate frame having a surface, the license plate frame comprising a perimeter around an orifice, the perimeter being configured to overlay a surface of a license plate and retain the license plate, the orifice being configured to permit characters on the license plate surface to be viewable to persons proximate the license plate surface when the license plate is retained by the perimeter;

an opening extending through the license plate frame surface, the opening extending only partially into the license plate frame; and a loop antenna within the opening, the loop antenna being in electrical connection with the RFID and extending entirely around the perimeter to surround the orifice.

* * * * *